US005878961A

United States Patent [19]

Mueller et al.

[11] Patent Number: 5,878,961

[45] Date of Patent: Mar. 9, 1999

[54] INJECTION VALVE FOR INJECTING FUEL DIRECTLY INTO A COMBUSTION CHAMBER OF AN INTERNAL COMBUSTION ENGINE

[75] Inventors: Martin Mueller, Moeglingen; Christian Preussner, Markgroeningen, both of Germany

[73] Assignee: Robert Bosch GmbH, Stuttgart, Germany

[21] Appl. No.: 858,475

[22] Filed: May 20, 1997

[30] Foreign Application Priority Data

Jun. 14, 1996 [DE] Germany ..... 196 23 713.0

[51] Int. Cl.[6] ..... F02M 67/02

[52] U.S. Cl. ..... 239/453; 239/584; 239/590

[58] Field of Search ..... 239/453, 459, 239/460, 584, 585.1–585.5, 533.12, 590

[56] References Cited

U.S. PATENT DOCUMENTS

| | | | |
|---|---|---|---|
| 1,758,119 | 5/1930 | Le Moon | 239/453 X |
| 2,187,797 | 1/1940 | Tedeschi | 239/453 |
| 3,791,589 | 2/1974 | Pagdin | 239/453 |
| 4,597,558 | 7/1986 | Hafoser et al. | 239/585.3 X |
| 5,048,497 | 9/1991 | Kishida et al. | 239/585.3 X |
| 5,058,549 | 10/1991 | Hashimoto et al. . | |
| 5,516,047 | 5/1996 | Kubach et al. . | |

FOREIGN PATENT DOCUMENTS

| | | |
|---|---|---|
| 43 28 418 A 1 | 3/1995 | Germany . |
| WO 93/23172 | 11/1993 | WIPO . |

*Primary Examiner*—Kevin Weldon
*Attorney, Agent, or Firm*—Kenyon & Kenyon

[57] ABSTRACT

An injection valve, particularly for injecting fuel directly into a combustion chamber of an internal combustion engine, has a flow path whose end region encompasses an annular gap on the outlet side, and which, in the open state, has at least one annular injection opening that is provided on the outlet side in a closing part, downstream of the annular gap with respect to the flow direction. To achieve good fuel distribution during injection, particularly in a combustion chamber of an internal combustion engine, and to be able to set the penetration of the fuel stream into the combustion chamber, means are associated with the annular gap that determine the cross section of the flow path establishing the flow volume such that this cross section has varying radial widths in a circumferential direction of the annular gap.

15 Claims, 3 Drawing Sheets

INJECTION VALVE FOR INJECTING FUEL DIRECTLY INTO A COMBUSTION CHAMBER OF AN INTERNAL COMBUSTION ENGINE

FIELD OF THE INVENTION

The present invention relates to an injection valve, particularly for injecting fuel directly into a combustion chamber of an internal combustion engine.

BACKGROUND INFORMATION

A known injection valve of this type (International Application No. WO 93/23 172) for injecting fuel directly into the combustion chamber of an internal combustion engine comprises a valve body disposed inside a valve housing and having a valve opening, which is surrounded by a valve seat on the spraying side, and through which a valve needle that supports a closing head extends such that, when the valve is closed, the closing head rests with its sealing surface against the valve seat from the outside. When the valve is open, that is, when the closing head of the valve needle is lifted from the valve seat in the direction of injection, the outlet opening defined between the valve seat and the sealing surface forms an injection opening, which adjoins an annular gap provided in the end region of a flow path for fuel through the injection valve, and which represents the smallest cross section in the flow path for the fuel dosing.

In another known injection valve (U.S. Pat. No. 5,058,549), a valve needle having a closing head is disposed inside a housing. The closing head has a conical sealing surface, which cooperates with a valve seat provided in front of an injection opening arrangement with respect to the direction of injection. Provided behind the valve seat, in a dome-shaped housing section, are a primary and a secondary injection opening, which allow fuel to be injected into the primary region as well as into the region of a combustion chamber in which the spark plug is disposed.

In another known injection valve (German Patent Application No. DE 43 28 418 A1), a nozzle plate is disposed in the valve housing behind a valve seat that cooperates with a valve needle, the plate having a retaining plate with a stepped, throughgoing bore in which an injection plate is inserted. Provided in the spray-side edge region of the injection plate is a recess which, together with an associated recess on the retaining plate, forms an annular channel whose outlet-side edges define an annular outlet gap on the holding and injection plates, which forms an injection opening with a dosing function. The annular channel of this known injection plate is connected to the supply side of the nozzle plate via slots provided in the injection plate such that the fuel flowing into the annular channel is equally distributed and can be injected in the circumferential direction as identically-shaped fuel sheets.

SUMMARY OF THE INVENTION

In contrast, the injection valve of the present invention has the advantage that a fuel stream can be injected in the form of numerous stream components; namely, the stream has alternating regions, when seen in its circumferential direction, into which relatively high or low volumes of fuel are injected. In this manner, the individual components of the fuel stream can be sprayed different distances. Thus, particularly in direct injection of fuel into a combustion chamber of an internal combustion engine, the penetration of the fuel stream into the chamber can be set as desired in order to achieve good fuel distribution with good fuel processing for the subsequent ignition process.

In purposeful structuring of the fuel stream, it is particularly advantageous to use a disk that is provided with a structure corresponding to the desired separating of the fuel stream through the use of a microstructuring production technique (MIGA technique—i.e., a microgalvanizing technique). This allows a calibration of the fuel flow through the injection valve that is especially favorable to production.

A further advantage of the injection valve of the present invention is that, aside from the independence of the dosing function from the valve needle stroke, the injection region and the dosing region are insensitive to contamination by impurities carried in the fuel (e.g., production shavings and other deposits).

BRIEF DESCRIPTION OF THE DRAWINGS

Exemplary embodiments of the present invention are illustrated in drawings and are explained in more detail hereafter.

Corresponding parts are provided with identical reference numerals in the different drawing figures.

DETAILED DESCRIPTION OF THE INVENTION

Figure 1:
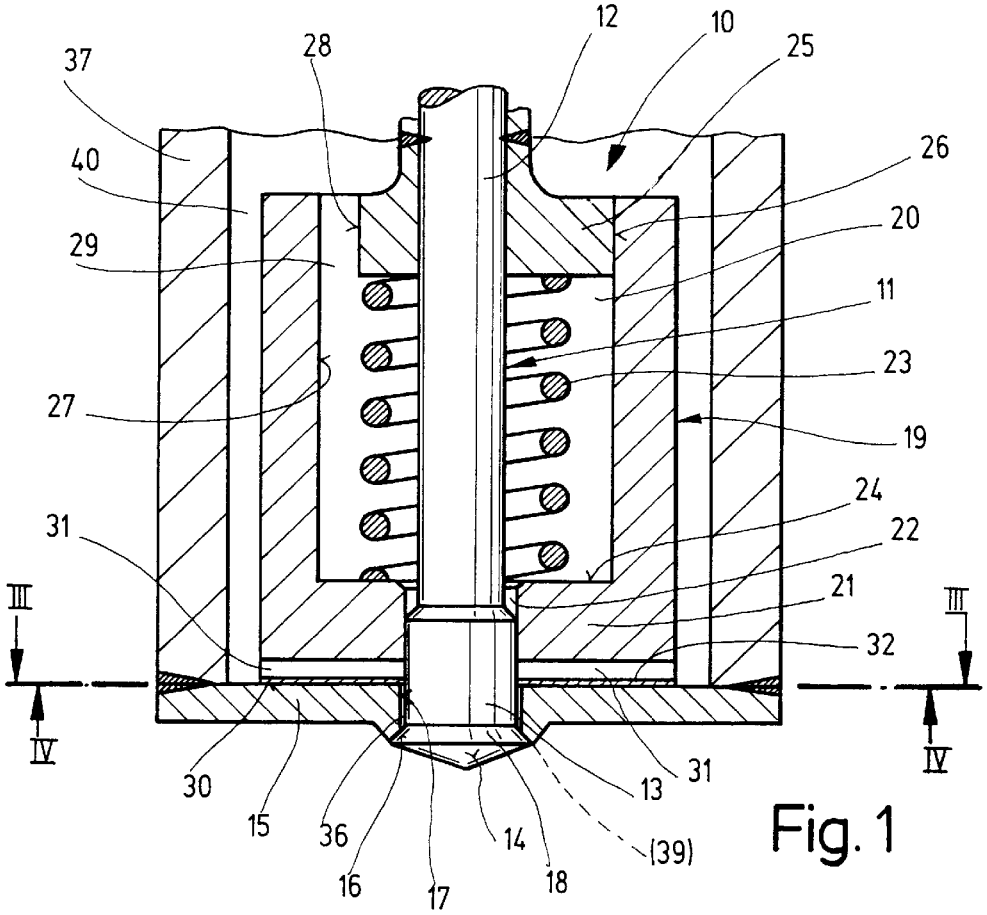
FIG. 1 depicts a schematic section through a valve unit of an injection valve according to the present invention.

As shown in FIG. 1, a valve unit 10 of an injection valve according to the present invention comprises a valve needle 11 having a shank 12, a widened guide section 13 and a closing head 14 that is disposed at the end of guide section 13 of valve needle 11 facing away from shank 12. Valve needle 11 extends with its guide section 13 through a valve opening 17, which is surrounded by a valve seat 16 disposed in a valve plate 15 that serves as a closing part of the injection valve, such that a sealing surface 18 provided at closing head 14 for closing the valve can be brought into contact with valve seat 16.

An essentially cup-shaped guide body 19 having a spring chamber 20 is provided for guiding valve needle 11. A guide bore 22 that cooperates with guide section 13 of valve needle 11 is cut into a floor 21 of guide body 19.

A closing spring 23 is provided for bracing guide body 19 with its floor 21 against valve plate 15, and for simultaneously prestressing valve needle 11 in its closed position, in which sealing surface 18 on closing head 14 rests so as to seal against valve seat 16. The closing spring is tensed in spring chamber 20, between a supporting surface 24 on floor 21 and an abutment disk 25, which is secured to shank 12 of valve needle 11. Abutment disk 25 can be secured to shank 12 of valve needle 11 by means of a welded connection, for example through laser welding.

Abutment disk 25 is guided with its outer circumferential surface 26 against an inner wall 27 of spring chamber 20, and has a recess, e.g., a milled surface 28, that forms a connecting opening 29, through which fuel can enter spring chamber 20 and exit the chamber during an opening movement of valve needle 11.

Instead of being guided by the cup-shaped guide body 19, valve needle 11 can also be guided in a guide sleeve having a radially outwardly-extending flange that is pressed against valve plate 15 and provides a supporting surface for closing spring 23.

Supply grooves 31 extending from the outer circumference of guide body 19 into the region of guide bore 22 are provided in an end face 30 of guide body 19 that faces valve plate 15.

Figure 4:
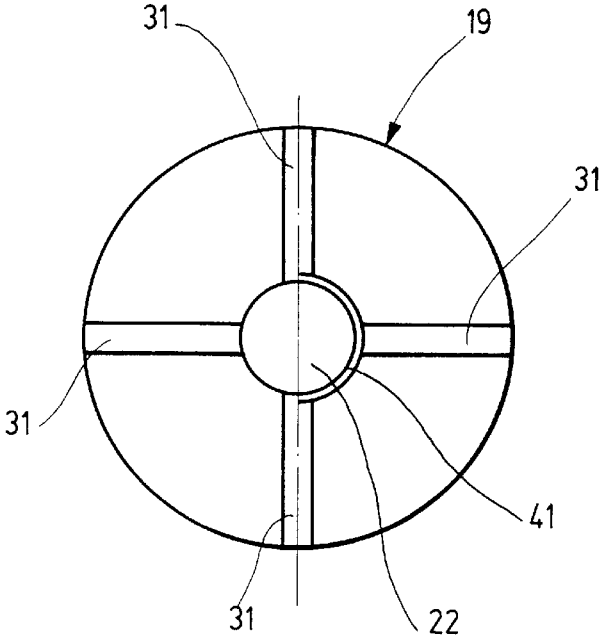
FIG. 4 depicts a plan view, essentially according to line IV—IV in FIG. 1, of a guide body for a valve needle of the valve unit according to the present invention.
Figure 5:
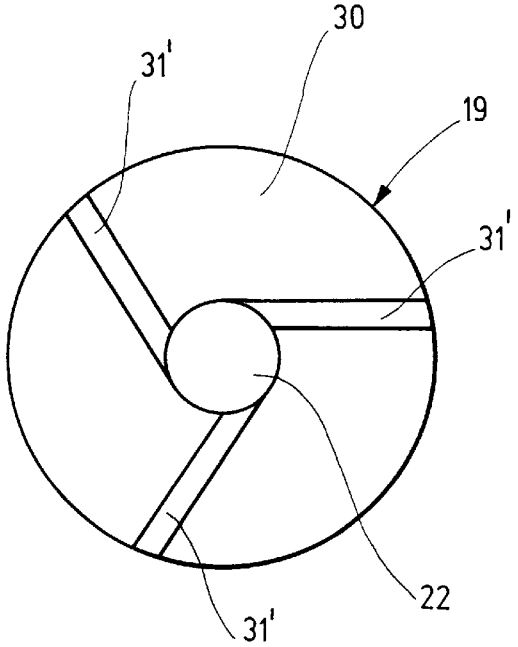
FIG. 5 depicts a view, corresponding to FIG. 4, of a different embodiment of the guide body according to the present invention.

As illustrated in FIG. 4, supply grooves 31 are disposed radially. It is also possible to provide supply grooves 31' which, as illustrated in FIG. 5, terminate essentially tangentially in the region of guide bore 22. The orientation of supply grooves 31, 31' can also be selected differently to influence the flow of fuel in the region adjacent to guide bore 22.

A thin disk 32 is disposed between guide body 19 and valve plate 15 as means for determining the cross section of the flow path that establishes the flow volume. The disk has an opening 33, which is associated with the valve opening and guide bore 22 in guide body 19.

The thin disk 32, which comprises metal, is, for example, approximately 0.2 mm thick and is tightly clamped or welded between guide body 19 and valve plate 15. It is also conceivable to configure floor 21 of guide body 19 correspondingly to include a freely-movable seating of disk 32.

Figure 3:
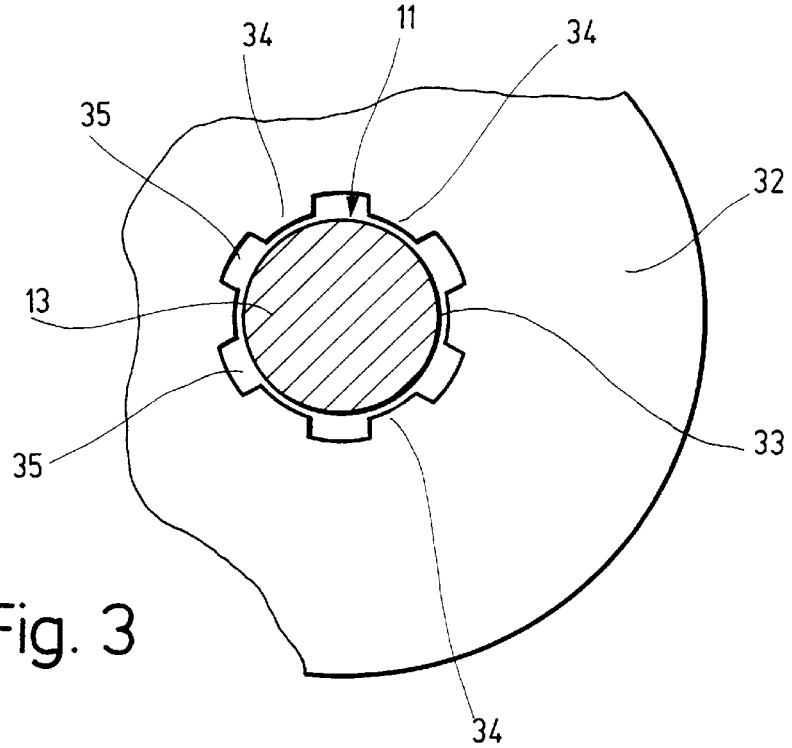
FIG. 3 depicts a section according to line III—III in FIG. 1, with a corresponding plan view of a disk for setting the flow of the fuel according to the present invention.

As illustrated in FIG. 3, opening 33 has a toothed edge with webs 34 and channels 35 between the webs. Webs 34 essentially rest against guide section 13 of valve needle 11, whereas channels 35 provide a flow path for the fuel from supply grooves 31 to an annular gap 36, which is formed between guide section 13 of valve needle 11 and the inner circumferential surface of valve opening 17. With the webs 34 adjacent to valve needle 11, disk 32 can easily be aligned radially with annular gap 36 during assembly of valve unit 10.

To ensure a defined installed, rotational position of disk 32 in the injection valve, corresponding alignment means can be provided on disk 32. For example, the outer circumference of disk 32 can be provided with notches or flattened areas. A defined alignment of the installed, rotational position of disk 32 in the injection valve allows the injection valve to be installed in the cylinder head of an internal combustion engine with a defined installed, rotational position.

In the illustrated embodiment according to the present invention, opening 33 of disk 32 is structured such that six channels 35 are formed. Depending on the desired structure of the injected fuel stream, however, more or fewer channels 35 can be provided. Channels 35 can also have varying cross sections, and/or can be distributed unevenly over the circumference of opening 33 or the annular gap.

Disk 32 is advantageously manufactured in accordance with a microstructuring method (e.g., a microgalvanizing method—MIGA technique). It is possible to select the flow calibration, that is, to set the dosing function of the injection valve, and, at the same time, a fine structuring of the injected fuel stream, by selecting the number of channels 35 and the highly-precise technique used to produce them.

Instead of using disk 32, with the alternating webs 34 and channels 35, to determine the narrowest cross section that establishes the flow volume in the flow path, it is also possible to provide the outer circumferential surface of guide section 13 of valve needle 11 with axial or helical grooves that form channels with interspaced webs in the region of the valve opening. Gap 36 has regions having larger and smaller radial widths distributed along its circumference.

Figure 2A:
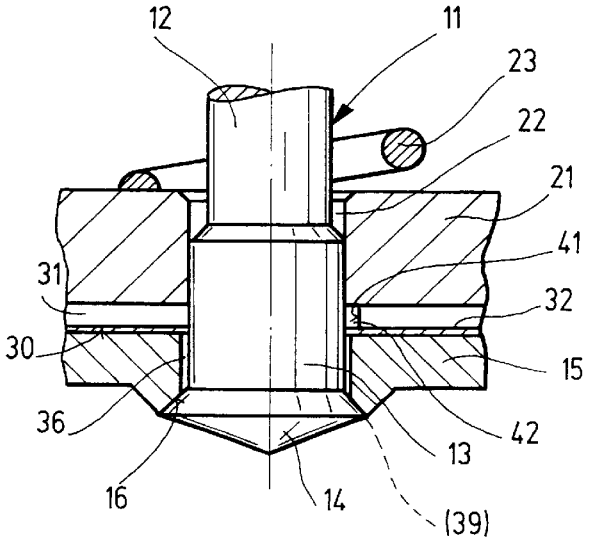
FIGS. 2*a* and 2*b* depict an enlarged, schematic section through the injection region of the valve unit of FIG. 1, in the closed and opened states, respectively.
Figure 2B:
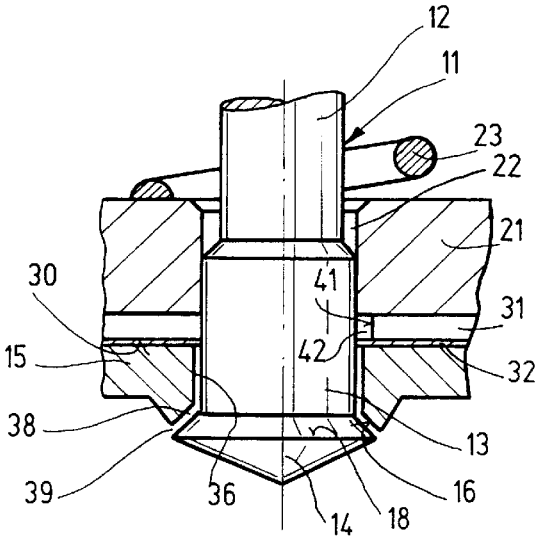

To achieve uniform fuel distribution along the supply side of channels 35, an indentation 41 surrounding guide bore 22 can be provided in end face 30 of guide body 19, as illustrated in the right halves of FIGS. 2*a*, 2*b* and 4. The indentation forms an annular channel 42 in front of the cross section of the flow path that determines the flow volume. Insofar as the individual channels 35 possess the same flow resistance, this allows the same fuel volume to flow through the narrowest flow cross section of each channel 35.

The supply of fuel to channels 35 of disk 32 or to gap 36 can be achieved through other suitable means. For example, it would be possible to provide guide section 13 with recesses in the region of guide bore 22, through which fuel could flow to the inlet region of gap 36.

Valve unit 10, with valve plate 15, is tightly mounted, particularly welded, to an outlet part 37 of an injection valve housing, which is not depicted in detail.

When the described injection valve is operated, valve needle 11 is displaced by an activation device, which is not depicted in detail, against the force of closing spring 23, whereby—as depicted in FIG. 2*b* —closing head 14 rises with its sealing surface 18 from valve seat 16 so that a cone envelope-shaped injection gap 38 is formed, representing an annular injection opening 39 on the outlet side.

Thus, when the injection valve is open, fuel can flow from a internal chamber 40 in the outlet part 37, which chamber surrounds valve unit 10, through supply grooves 31, channels 35, annular gap 36 and injection gap 38 to injection opening 39 and be injected through the opening, for example into the combustion chamber of an internal combustion engine.

This determines the cross section of the flow path from the channels 35 of the disk 32, which establishes the flow volume of fuel through the injection valve. As a result of the structuring of opening 33 of disk 32 according to the present invention, the fuel does not flow evenly, but in separate streams, into annular gap 36. The purposeful, irregular distribution of fuel in annular gap 36 that is achieved here is extensively maintained, even in injection gap 38 and in injection opening 39, so that a separated fuel stream is injected.

This is advantageous because the fuel components in the portions of the injected fuel stream can be sprayed further than the fuel components located in the regions between the portions. Hence, a more uniform distribution of fuel is achieved in the combustion chamber, particularly when fuel is injected directly in the combustion chamber of an internal combustion engine.

An additional advantage is that, with a corresponding installed, rotational position of the injection valve of the present invention, a gap between two fuel portions can be aligned with the spark plug so that the spark plug is purposefully supplied with fuel. In particular, this avoids misfires as a result of too much or too little fuel in the region of the spark plug. Additionally, deposits on the spark plug electrodes can be avoided because the electrodes can be prevented from cooling too far by a corresponding alignment of the injection valve.

Figure 6:
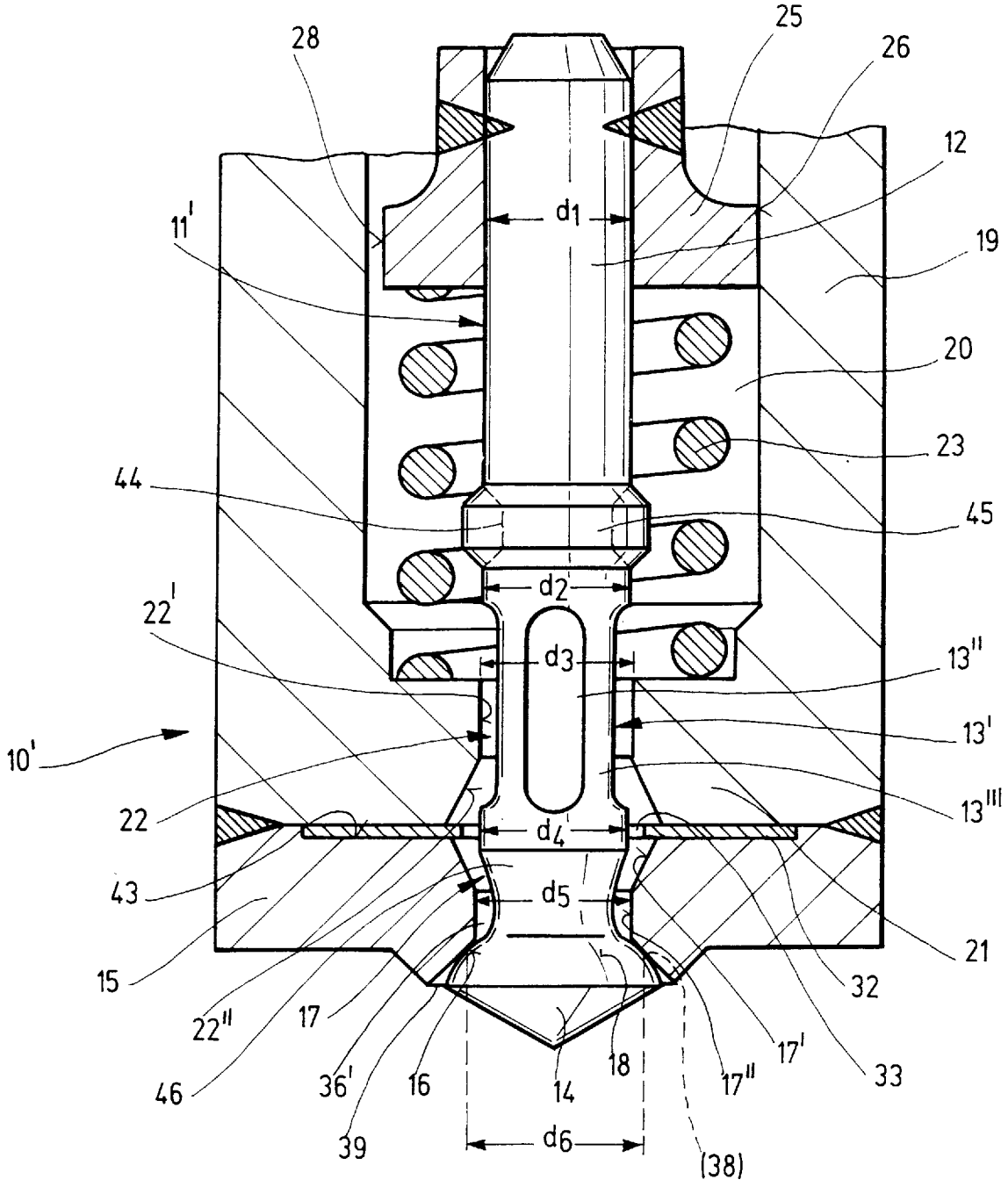
FIG. 6 shows an embodiment of an injection valve according to the present invention.

In a further embodiment of the present invention illustrated in FIG. 6, valve unit 10' has a cup-shaped guide body 19 into whose floor 21 a guide bore 22 is cut for a valve needle 11'; the guide body further has a valve plate 15 that possesses a valve opening 17 and is attached, particularly welded, to floor 21, adjacent to guide body 19. Guide body 19 is tightly connected, in a manner not depicted in detail, to an outlet part of the injection valve. Valve plate 15 is provided with a recess 43 on the side facing guide body 19, in which recess a thin disk 32 is disposed as the means for determining the cross section of the flow path that establishes the flow volume.

Guide bore 22 has a guide section 22' and a conically-widened section 22" facing thin disk 32. A conically-tapering section 17' of valve opening 17 is located opposite conically-widened section 22", which is adjoined by a cylindrical section 17" surrounded by a valve seat 16 in the direction of injection.

Valve needle 11' comprises a shank 12 having an outer diameter $d_1$, a guide section 13' having an outer diameter $d_2$, and a closing head 14 having a conical or spherical sealing surface 18 that cooperates with valve seat 16. Near guide section 13', a securing ring 45 is disposed in a groove 44 on the shank 12 as a means for enlarging the diameter. The outer diameter of the securing ring is larger than the inner diameter $d_3$ of guide section 22' of guide bore 22.

To create a flow path for fuel from a spring chamber 20 in guide body 19 to valve opening 17 and further to injection opening 39, guide section 13' of valve needle 11' is provided with recesses, e.g., milled surfaces 13", between which guide webs 13'" are formed. Furthermore, a perforation 46 is provided between the end region of guide section 13' of valve needle 11', which region cooperates with disk 32, and closing head 14. The perforation and cylindrical section 17" of valve opening 17 together form an annular gap 36', which terminates into injection gap 38 between sealing surface 18 and valve seat 16 when the injection valve is open.

The outer diameter $d_4$ of the end region of guide section 13', which, together with toothed opening 33 in disk 32 determines the cross section of the flow path that establishes the flow volume, is approximately the same as the inner diameter $d_5$ of cylindrical section 17" of valve opening 17.

To minimize the hydraulic forces influencing the valve needle 11', the valve seat diameter $d_6$ is only slightly larger than the outer diameter $d_4$ of the end region of guide section 13' of valve needle 11'.

The essentially cone envelope-shaped injection gap 38, which represents the annular injection opening 39 on the outlet side, is formed during normal operation of the injection valve described in conjunction with FIG. 6.

Thus, when the injection valve is open, fuel can flow from spring chamber 20, through guide bore 22, channels 35 provided between disk 32 and the end region of guide section 13' of valve needle 11', annular gap 36 and injection gap 38 to injection opening 39, through which it can be injected, for example into the combustion chamber of an internal combustion engine. As in the embodiment described in conjunction with FIG. 1, the separating of the fuel flow in accordance with the present invention is maintained from behind disk 32 up into injection opening 39, so that a separated fuel stream is injected.

The securing ring 45 disposed on valve needle 11' ensures that valve needle 11' cannot be pressed out of the injection valve into the combustion chamber in the event that shank 12 of valve needle 11' breaks or the connection between valve needle 11' and abutment disk 25 ruptures. As soon as valve needle 11' breaks or tears, for example, it slides, with the segment of guide section 13' adjacent to securing ring 45, into guide section 22' of guide bore 22, whereby securing ring 45 comes into contact with floor 21 of guide body 19, preventing further displacement of valve needle 11'. At the same time, the end region of guide section 13' adjacent to perforation 46 slides into cylindrical section 17" of valve opening 17.

Thus, fuel is prevented from flowing out into the combustion chamber by both securing ring 45 resting against floor 21 of guide body 19, as well as a suitable selection of the outer diameters $d_2$ and $d_4$ for guide section 13' of valve needle 11' relative to the inner diameters $d_3$ and $d_5$ of guide bore 22 and valve opening 17, respectively. It is useful for the individual diameters $d_2$, $d_3$, $d_4$ and $d_5$ to be approximately the same. In the failure scenario described, this results in a sealing gap that prevents the flow of fuel between the circular cylindrical end regions of guide section 13' at valve needle 11' and guide bore 22 or valve opening 17.

To achieve the most stable attachment possible of valve needle 11' to abutment disk 25, the outer diameter $d_1$ of valve needle 11' should be as large as possible. A relatively thick valve needle 11' has the additional advantage that it can be manufactured and assembled more easily. In particular, it can be ground better.

What is claimed is:

1. An injection valve for injecting fuel directly into a combustion chamber of an internal combustion engine, comprising:

a valve plate having a valve opening;

a valve needle passing through the valve opening of the valve plate, an annular gap being formed between the valve needle and the valve opening; and means associated with the annular gap for determining a cross section of a flow path through the annular gap such that the cross section has varying radial widths in a circumferential direction of the annular gap;

wherein the valve plate has a supply side and the annular gap has an inlet opening, and wherein the means associated with the annular gap includes:

a disk disposed upstream of the annular gap, the disk partially covering the inlet opening of the annular gap.

2. The injection valve according to claim 1, wherein the means associated with the annular gap includes webs and nonoverlapping voids, wherein the nonoverlapping voids include channels.

3. The injection valve according to claim 2, wherein the webs are spaced equidistantly in a circumferential direction.

4. The injection valve according to claim 1, wherein the disk includes webs and nonoverlapping voids, wherein the nonoverlapping voids include channels.

5. The injection valve according to claim 4, wherein the channels have a defined installed, rotational position.

6. An injection valve for injecting fuel directly into a combustion chamber of an internal combustion engine, comprising:

a valve plate having a supply side, an outlet side, a valve opening, and a valve seat disposed on the outlet side of the valve plate and surrounding the valve opening;

a valve needle passing through the valve opening of the valve plate, a closing head being disposed on the valve needle, the closing head resting against the valve seat of the valve plate when the injection valve is in a closed position, an annular gap being formed between the valve needle and the valve opening of the valve plate, the annular gap having an inlet opening;

a guide body cooperating with the valve needle; and a disk disposed between the guide body and the supply side of the valve plate, the disk having a central opening, the disk being centered with respect to the valve opening of the valve plate and partially covering the inlet opening of the annular gap, the disk being associated with the annular gap for determining a cross section of a flow path through the annular gap such that the cross section has varying radial widths in a circumferential direction of the annular gap.

7. The injection valve according to claim , wherein the disk is clamped between the guide body and the valve plate.

8. The injection valve according to claim 6, wherein the guide body and the valve plate are separated to allow the disk to move radially between the guide body and the valve plate.

9. The injection valve according to claim 6, wherein the guide body has an end face and an outside region, the guide body having supply grooves in the end face, the supply grooves resting against the disk and extending from the outside region of the guide body into the central opening of the disk.

10. The injection valve according to claim 9, wherein the supply grooves have a tangential component with respect to the central opening of the disk so that fuel flows into the annular gap with a circumferential component.

11. An injection valve for injecting fuel directly into a combustion chamber of an internal combustion engine, comprising:

a valve plate having a supply side, an outlet side, a valve opening, and a valve seat disposed on the outlet side of the valve plate and surrounding the valve opening;

a guide body having a guide bore;

a valve needle having a guide section, the guide section having recesses and passing through the guide bore, the valve needle passing through the valve opening of the valve plate and a closing head being disposed on the valve needle to form an interface, the closing head resting against the valve seat of the valve plate when the injection valve is in a closed position, an annular gap being formed between the valve needle and the valve opening, the annular gap having an inlet opening; and a disk disposed between the guide body and the supply side of the valve plate, the disk having a central opening, the disk being centered with respect to the valve opening of the valve plate and partially covering the inlet opening of the annular gap, the disk being associated with the annular gap for determining a cross section of a flow path through the annular gap such that the cross section has varying radial widths in a circumferential direction of the annular gap.

12. The injection valve according to claim 11, wherein:

the guide bore of the guide body has a diameter $d_3$ and has a first widened section;

the valve opening of the valve plate has a second widened section adjacent to the supply side of the valve plate and also has an adjoining cylindrical section having a diameter $d_5$, the valve needle has a perforation disposed between the recesses of the guide section and the interface of the closing head disposed on the valve needle; and wherein the valve needle has a diameter $d_2$ above the recesses of the guide section and a diameter $d_4$ below the recesses of the guide section, diameters $d_2$ and $d_4$ being approximately equal to diameters $d_3$ and $d_5$, respectively.

13. The injection valve according to claim 6, wherein the guide body has a guide bore through which the valve needle passes, further comprising:

means connected to the valve needle for enlarging a diameter of the valve needle, the means being connected to a side of the valve needle in the guide bore facing away from the closing head.

14. The injection valve according to claim 13, wherein the means for enlarging the diameter of the valve needle includes a securing ring disposed in a groove of the valve needle.

15. The injection valve according to claim 6, wherein the valve seat of the valve plate has a diameter which is slightly larger than a diameter of the valve opening of the valve plate.

* * * * *